US008671899B2

(12) United States Patent
Al-Khulaifi et al.

(10) Patent No.: US 8,671,899 B2
(45) Date of Patent: Mar. 18, 2014

(54) ROTARY VALVE SYSTEM

(76) Inventors: Khalid Al-Khulaifi, Al-Yarmouk (KW); Waleed Al-Refae, Hawally (KW); Abdulla Al-Mazrouee, Kuwait (KW)

( * ) Notice: Subject to any disclaimer, the term of this patent is extended or adjusted under 35 U.S.C. 154(b) by 225 days.

(21) Appl. No.: 13/352,731

(22) Filed: Jan. 18, 2012

(65) Prior Publication Data

US 2013/0180492 A1 Jul. 18, 2013

(51) Int. Cl.
*F01L 7/06* (2006.01)

(52) U.S. Cl.
USPC ..... 123/80 D; 123/190.4; 123/190.14

(58) Field of Classification Search
USPC ..... 123/80 R, 80 BA, 80 BB, 80 D, 80 DA, 123/81 D, 190.1, 190.4, 190.14
See application file for complete search history.

(56) References Cited

U.S. PATENT DOCUMENTS 1,002,756 A 9/1911 Reynolds
1,068,632 A 7/1913 Marshall
1,084,410 A 1/1914 Drennon
1,304,839 A 5/1919 White
1,975,777 A 10/1934 Bournonville
2,231,547 A 2/1941 Patchett
5,839,399 A 11/1998 Luce
7,287,495 B1 10/2007 Rowe

*Primary Examiner* — Noah Kamen

(74) *Attorney, Agent, or Firm* — Lowe Hauptman & Ham, LLP

(57) ABSTRACT

The present invention comprises a rotary valve apparatus for internal combustion engines having a cylindrical outer casing, an inlet port and an outlet port on an outer wall thereof. The cylindrical outer casing having a bottom opening and dimensioned and configured to be secured over an engine cylinder. An inner rotor having a shaft with a first end and a second end, and a lower circular member at the second end. The first end having a plurality of vertical splines and the lower circular member having a cutout portion, a circular end cap having an inlet port and an outlet port disposed within the bottom opening of the outer casing. The inner rotor rotatably mounted on the circular end cap wherein the cutout portion can align with the inlet port or the outlet port and a gear assembly rotating the inner rotor.

4 Claims, 5 Drawing Sheets

ROTARY VALVE SYSTEM

TECHNICAL FIELD

The present invention is generally directed toward a valve mechanism, and more specifically, a rotary valve system for internal combustion engines.

BACKGROUND OF THE INVENTION

Many prior art valve mechanisms for internal combustion engines have been developed in recent years. Conventional internal combustion engines used in the automotive industry use poppet valves, which intermittently open to allow intake of air and exhaust of waste gases to permit the cylinders to carry out the compression and combustion cycles of the engine. A conventional poppet valve system is spring-loaded and operates through the movements of rocker arms, lifters, push rods, and a camshaft, which camshaft is ultimately linked to the engine crankshaft.

The cycle of valve openings and closures taking place within this high pressure and temperature environment is impeded by friction or failure of parts. Furthermore, the operation of conventional poppet valves, which depends on the interaction of numerous small parts, is subjected to excessive wear and tear and includes various inefficiencies. These inefficiencies include, for example, parasitic loss in the form of reciprocating components inertia, pre-ignition due to high exhaust valve temperatures and wear of valve guides, all of which often result in excessive fuel consumption and emissions, vibration, and noise in the engine block. Moreover, the performance of each poppet valve and various components also depends upon a significant volume of oil needed for lubrication. In addition, as there are two or more poppet valves in use per cylinder, the valve bodies, lifters, pushrods, and springs in operation for each valve all have a mass that is twice accelerated and decelerated every crankshaft revolutions. These loads are continually taking power from the engine and considerably increase with the increase of engine speed. Also, the lower part of the valve stem which is exposed to inlet charge and exhaust gases works as an obstacle in which it reduces the mass of the inlet air charge and hence reduces the volumetric efficiency of the engine. Additionally, the poppet valves may require periodic adjustment or replacement of hydraulic lifters.

There have been many attempts to produce power units which would be superior to the internal combustion engine in its usual form. Some attempts have been simply to improve breathing of the reciprocating engine by alternative designs of the valve mechanism. These projects have had the object of basic improvements, and have included engines with fundamentally different geometry.

For example, U.S. Pat. No. 1,002,756 to Reynolds discloses a rotary valve disc 8 operated by miter gears 10, 11, to function with valves 14 and 15 and valve seats 13.

Another approach is disclosed in U.S. Pat. No. 1,084,410, to Drennon, in which rotary discs 12 and 15 are operated by gears 23 and 24.

One of the disadvantages associated with these prior art rotary valve mechanisms is the lack of simplicity in components and have many parts.

It is therefore a primary object of the present invention to provide a rotary valve apparatus which requires fewer components and it is simple in design, yet performs in a superior manner over the conventional poppet and prior art valves.

Notwithstanding the above, it is presently believed that there may be a significant demand in the marketplace for a rotary valve apparatus having the above-stated features of the present invention.

BRIEF SUMMARY OF THE INVENTION

These problems and others are addressed by the present invention which comprises a rotary valve apparatus for an internal combustion engine having a cylindrical outer casing including an inlet port and an outlet port on an outer wall thereof, the cylindrical outer casing having a bottom opening and dimensioned configured to secure over an internal combustion engine as a cylinder head, an inner rotor having a shaft with a first end and a second end, and a lower circular member at the second end, the first end having splines on an outer surface thereof, and the lower circular member having a cutout portion, a circular end cap having an inlet port and an outlet port and disposed within the bottom opening of the cylindrical outer casing, the inner rotor rotatably mounted on the circular end cap wherein the cutout portion can align with the inlet port or the outlet port as the inner rotor rotates, and means for rotating the inner rotor.

BRIEF DESCRIPTION OF THE DRAWINGS

These and other objects of the present invention will be appreciated and understood by those skilled in the art from the detailed description of the preferred embodiments of the invention and the following drawings of which.

DETAILED DESCRIPTION OF THE INVENTION

Figure 1:
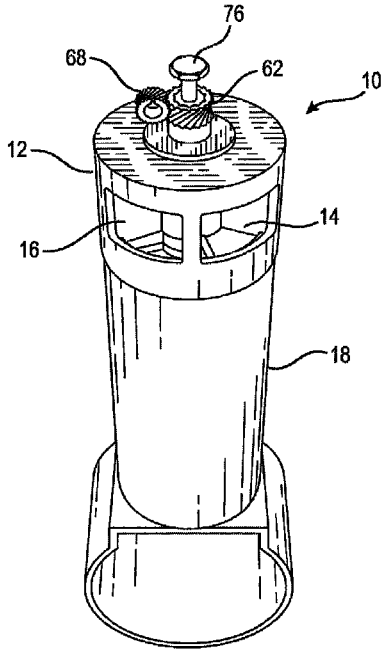
FIG. 1 is a perspective view of a rotary valve apparatus assembled on a cylinder of an internal combustion engine in accordance with a preferred embodiment of the present invention.

For the purpose of promoting and understanding of the principles of the invention, reference will now be made to the embodiments illustrated in the drawings. Referring now to the drawings, and more specifically to FIGS. 1 through 6, wherein the showings are for the purpose of illustrating the preferred embodiment of the invention only and not for the purpose of limiting the same, a rotary valve apparatus is generally illustrated at 10 having an outer casing 12 with a substantially cylindrical shape and configuration. The outer casing 12 includes, preferably, out an outer wall thereof an inlet port 14 and an outlet port 16 and preferably apart at a 90 degrees angle apart from one another circumferentially, and further, each preferably has a rectangular shape and configuration, although other shapes and configurations of the ports are contemplated to be within the scope of the present invention.

Figure 2:
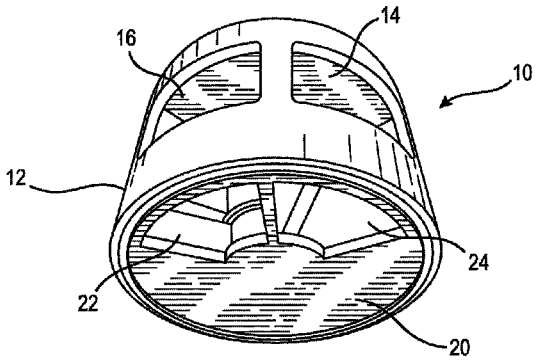
FIG. 2 is a perspective view of the rotary valve apparatus illustrating a bottom view thereof shown in FIG. 1.

The rotary valve apparatus 10 is operably disposed on a cylinder head 18 of an internal combustion engine essentially replacing the conventional cylinder head used for internal combustion engines. As best seen in FIG. 2, the cylindrical outer casing 12 also includes an end cap 20 in form of a bottom wall having a substantially circular shape adapted to fit within a bottom portion of the cylindrical outer casing 12 and further includes an inlet 22 and an outlet 24, which are primarily in the form quarter section cut-outs, and are in fluid connection with the inlet and outlet ports 14, 16, and which, as will be explained in greater detail, depending on the various cycles of the engine, provide for the inlet of air and fuel, and the end of combustion cycle, for the outlet of the gases.

Figure 6:
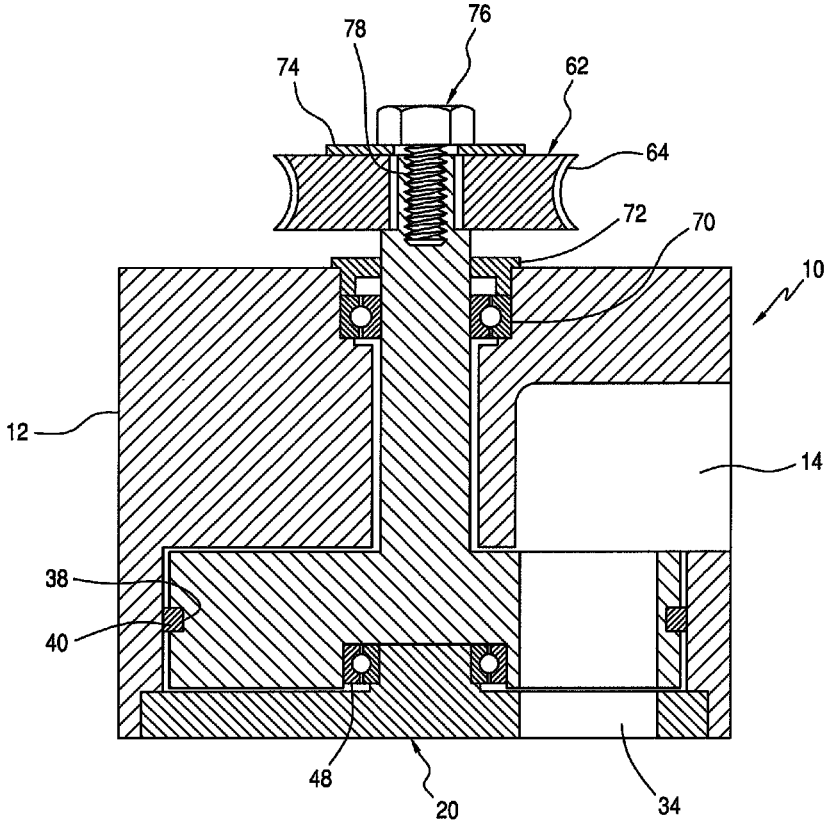
FIG. 6 is a cross-sectional view of the rotary valve apparatus in an assembled configuration of all the parts in accordance with the preferred embodiment of the present invention.
Figure 7:
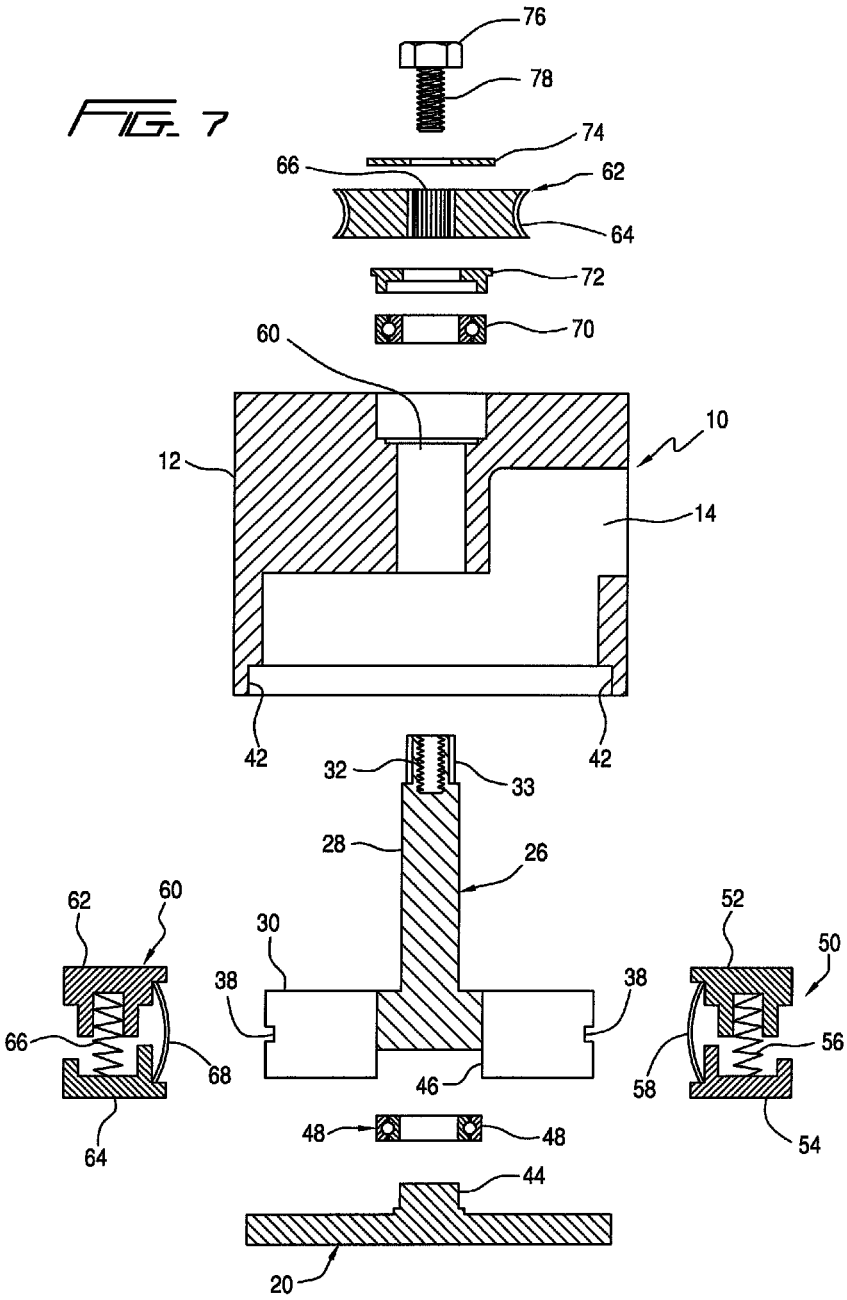
FIG. 7 is an exploded perspective view of the rotary valve apparatus illustrating various components thereof.

Referring more specifically to FIGS. 6 and 7, the rotary valve apparatus 10 further comprises an inner rotor 26 having a vertical elongate shaft 28, and an integrally formed with a lower circular part 30 at the bottom end of the elongate shaft 28. The opposing end of the elongate shaft 28 includes an inner threaded bore 32 and an outer splined portion 33, which as will be explained in greater detail herein, it engages the helical gear system.

Figure 8A:
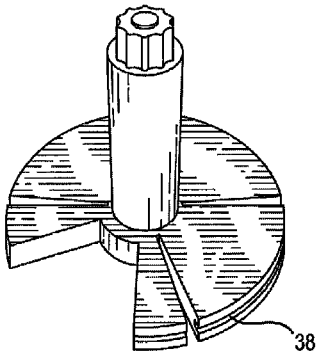
FIG. 8A is a top perspective view of the inner rotor of the rotary valve apparatus in accordance with a preferred embodiment of the present invention.
Figure 8B:
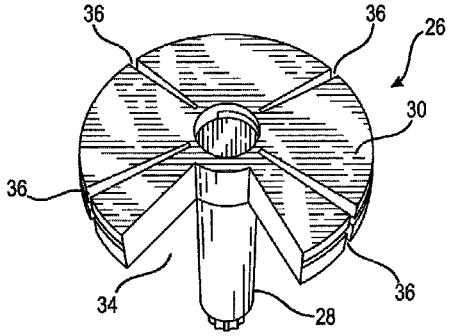
FIG. 8B is a bottom perspective view of the inner rotor of the rotary valve apparatus in accordance with the preferred embodiment of the present invention.
Figure 9:
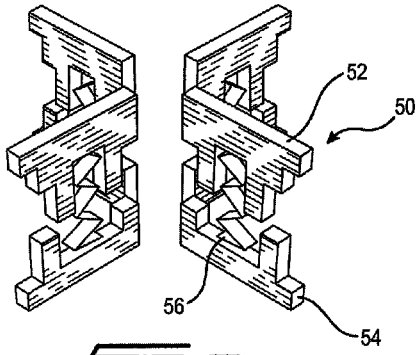
FIG. 9 is a perspective exploded view of the plurality of vanes component of the rotary valve apparatus in accordance with the preferred embodiment of the present invention.
Figure 10:
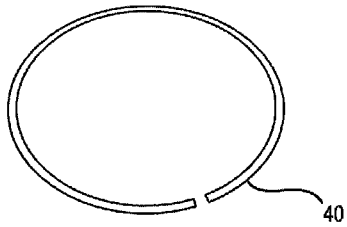
FIG. 10 is a perspective view of the seal ring used in the rotary valve apparatus of FIG. 1; and, FIG. 11 is a perspective view of the inner rotor of the rotary valve apparatus with the rotor cap in accordance with the preferred embodiment of the present invention.
Figure 11:
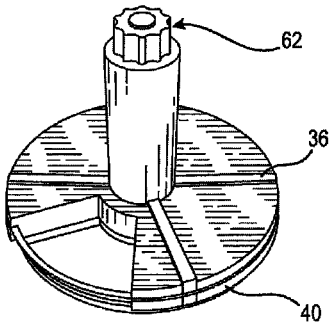

As best seen in FIG. 8B, the lower circular part 30 further includes a quarter section cutout portion 34 dimensioned and configured to align with the inlet 22 and outlet 24 during the combustion cycles, and further includes a plurality of slits, preferably but not limited to, four slits 36 equally spaced apart and extending from a peripheral edge of the lower circular part 30 to substantially a center of the inner rotor 26. The lower circular part 30 also includes a circumferential annular ridge 38 adapted to removably receive and secure a seal ring 40 therewithin, as best shown in FIG. 10. As stated hereinabove, the end cap 20 is secured within an inner peripheral indentation 42 of the cylindrical outer casing 12.

The end cap 20 further includes a upwardly protruding member 44 disposed at a center thereof. The lower circular part 30 includes a bearing case 46, wherein the protruding member 44 is received therewithin and the lower circular part 30 is rotatably secured to the end cap 20 with a bearing apparatus 48, thereby also resulting in the inner rotator 26 freely rotating within the cylindrical outer casing 12, and also allowing the lower circular part 30 to block access to inlet 22 and outlet 24 depending on the combustion cycle of the engine.

The rotary valve apparatus 10 further comprises a plurality of vanes 50, preferably but not limited to, four vanes 50, which will be explained in greater detail herein. Each vane 50 includes an upper member 52 and a lower member 54 attached to the upper member 52 by a helical spring 56 or other biasing means. The upper member 52 and the lower member 54 can move vertically relative to one another and fit precisely inside 36. The upper member 52 of each vane 50 engages the lower circular part 12 through the corresponding slit 36, and the lower member 54 engages the upper part of end cap 20. A biasing resilient member 58 is adapted at one side of the upper member 52 and the lower member 54 of each vane 50 and provides for a lateral biasing support force when the end cap 20 is in place and engages the outer circular wall of 90 to provide a constant biasing force to prevent gas escape in the lateral direction of 90.

The elongate shaft 28 of the inner rotor 26 extends through a cylindrical bore 60 of the cylindrical outer casing 12 and rotatably engages a gear mechanism which is explained herein in a greater detail. A first helical gear 62 having a substantially cylindrical shape and configuration includes a plurality of outer teeth 64 on an outer circumferential surface thereof. The first helical gear 62 further includes central bore having a plurality of inner vertical splines 66 within the bore. The plurality of inner vertical splines 66 mesh and engage the outer vertical splines portion 33 of the elongate shaft 28. A second bearing apparatus 70 and a seal for grease 72 together with a spring washer 74 secure the first helical gear 62 on top of the elongate shaft 28 using a screw 76 having a threaded post 78 tightened within the inner threaded bore 32. Grease is used for 48 and 70 in order to smooth the rotation of inner rotor 26. It is noted that other securing means, such as, but not limited to, for example rivet or welding are contemplated to be within the scope of the present invention.

Figure 3:
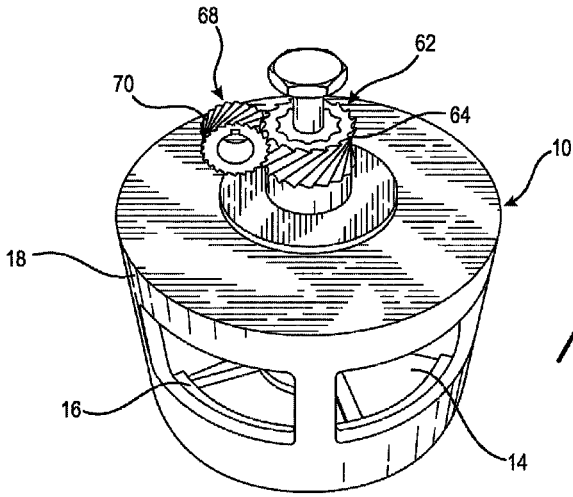
FIG. 3 is a perspective of the rotary valve apparatus shown in FIG. 1.
Figure 4:
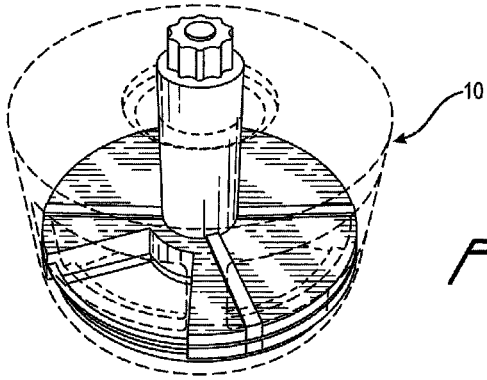
FIG. 4 is a perspective view of the rotary valve apparatus illustrating the inner rotor in an assembled configuration.
Figure 5:
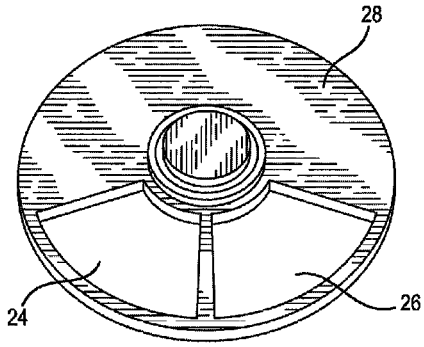
FIG. 5 is a planar view of the rotor cap of the rotary valve apparatus of the claimed invention.

As best seen in FIG. 3, a second helical gear 68 includes a plurality of outer teeth 70. The rotational input for the second helical gear 68 is provided through camshaft of the internal combustion engine. The plurality of outer teeth 70 engages and meshes with the plurality of outer teeth 64 of the first helical gear 62, and the rotation of the second helical gear 68 results in the rotational movement of the first helical gear 62. Broadly, the camshaft rotation which determines the cycle of the combustion engine causes the rotation of the first helical gear 62, which in turn causes the rotation of the elongate shaft and inner rotor 26, and the closing of inlet 22 and outlet 24 completing and going through the cycles of combustion of the internal combustion engine.

While preferred embodiments of the invention have been shown and described, various modifications and substitutions may be made thereto without departing from the spirit and scope of the invention. Accordingly, it is to be understood that the present invention has been described by way of illustration only, and this description should not be construed as limiting to the several claims appended hereto.

What is claimed is:

1. A rotary valve apparatus for an internal combustion engine, comprising:

a cylindrical outer casing having an inlet port and an outlet port on an outer wall thereof, said cylindrical outer casing having a bottom opening and dimensioned configured to secure over an internal combustion engine cylinder;

an inner rotor comprising a shaft having a first end and a second end, and a lower circular member attached to said second end, said first end having a plurality of vertical splines on an outer surface thereof, and said lower circular member having a cutout portion;

a circular end cap having an inlet port and an outlet port and disposed within said bottom opening of said cylindrical outer casing, said inner rotor rotatably mounted on said circular end cap wherein said cutout portion can align with said inlet port or said outlet port as said inner rotor.

2. The rotary valve apparatus for an internal combustion engine of claim 1, wherein said mean for rotating said inner rotor is a gear assembly further comprising a first helical gear secured to the splines of first end of said inner rotor, wherein said first helical gear engages a second helical gear rotated by a camshaft of said internal combustion engine, wherein said inner rotor is rotated through a combustion cycle wherein closing and opening access to said inlet and outlet ports.

3. The rotary valve apparatus for internal combustion engines of claim 2, further comprising a plurality of spring biases vanes disposed between said cylindrical base of said inner rotor and said rotor cap.

4. The rotary valve apparatus for internal combustion engines of claim 3, further comprising a securing means for attaching said first helical gear to said upper splined shaft portion on top of said outer casing.

* * * * *